United States Patent [19]

Casey

[11] Patent Number: 4,621,737

[45] Date of Patent: Nov. 11, 1986

[54] SKI RACK

[76] Inventor: Thomas P. Casey, P.O. Box 3636, Ketchum, Id. 83340

[21] Appl. No.: 590,007

[22] Filed: Mar. 15, 1984

[51] Int. Cl.[4] ..... A47F 7/00

[52] U.S. Cl. ..... 211/70.5; 211/71; 211/189

[58] Field of Search ..... 211/70.5, 60 R, 60 G, 211/60 M, 60 T, 62, 65, 67, 68, 71, 189

[56] References Cited

U.S. PATENT DOCUMENTS

| | | | |
|---|---|---|---|
| 152,655 | 2/1949 | Rossell | 211/60.1 |
| 185,807 | 8/1959 | Antle | 211/60.1 |
| 616,555 | 12/1898 | Paddock | 211/62 |
| 1,845,881 | 2/1932 | Kuehner | 211/62 |
| 2,614,698 | 10/1952 | Bell | 211/62 |
| 2,963,165 | 12/1960 | Steiner | 211/4 |
| 3,315,815 | 4/1967 | Witlek | 211/70.2 |
| 4,190,166 | 2/1980 | Allsop | 211/60.1 |

*Primary Examiner*—Ramon S. Britts
*Assistant Examiner*—Sarah Lechok Eley
*Attorney, Agent, or Firm*—Hedman, Gibson, Costigan & Hoare

[57] ABSTRACT

A ski rack for holding several pairs of skis and poles in a vertical position comprising a base, means formed in the base for holding the poles and ski holding means extending perpendicularly from said base.

3 Claims, 5 Drawing Figures

56
2
54
36
34
36
32
48
10
10
36
34
36
34
10
10
32
32
32
32
26
38
42
42
40
58
46
44
44
26
26
4
14
18
52
50

SKI RACK

BACKGROUND OF THE INVENTION

A persistent problem that has faced skiers is the unavailability of means for storing skis. This problem occurs any time skiers are not using their skis. It is particularly troublesome when the skier temporarily removes his skis during a session of skiing.

At present, when a skier stops skiing for a time in order to enter a restaurant or lodge, typically he must place his or her skis in wooden racks outside the ski lodge. The racks consist primarily of strips of wood forming a large compartment where large numbers of skis are bunched together. There is no provision for storing skis inside the lodge or restaurant. In fact, the lodge or restaurant does not generally allow skis to be brought inside because there is no convenient place to store the skis. In addition, the water from the melting snow on the skis may damage carpets and flooring.

Furthermore, there is now no convenient storage rack that can be used in the home for the orderly storage of skis. Thus, the skis when stored at home are customarily piled against each other, probably flat on the floor, where they are likely to become damaged or interfere with storage of other items.

Hence, there is a need for a convenient ski rack that can be used both inside and outside a lodge, restaurant or home to hold the skis and poles in an orderly vertical position.

SUMMARY OF THE INVENTION

The device according to the subject invention provides a ski rack for holding several pairs of skis and the corresponding poles in a vertical position. The ski rack consists of a base, ski holding means extending perpendicularly from the base and means formed in the base to secure the poles. In one embodiment, the ski rack is a single integral unit.

The means to secure the poles consists of a plurality of "X" shaped cavities formed in the base within which the poles are inserted. The depth of the cavities must be sufficient to support the weight of the poles. The base is also provided with a means for catching the water runoff from the snow melting on the skis. An outer channel running along the outer perimeter of the base is connected to the ski holding means by a series of inner channels. The water runs off the skis, through the inner channels and is caught in the outer channel. Thus, a light weight, convenient ski rack is provided that can be used outside or inside a lodge, restaurant or in the home.

In another embodiment, the ski rack is disassemblable. Therein, the ski holding means are separate from the base and require means for retention of the ski holding means to the base. A securing means is employed to releasably secure the ski holding means to the base. The ski holding means comprises a plurality of elongated tubular members mounted contiguous to each other at the center of the base. The base is supplied with a recessed section in the center for receiving the tubular members. The ski holding means are selected to minimize the bending movement of the skis, thereby maintaing the skis in the vertical position. In addition, the width of the base and the depth of the recessed section are selected to support the weight of the skis.

It is an object of the subject invention to provide a convenient ski rack for holding a plurality of skis and poles in a vertical position.

It is another object of the subject invention to provide a ski rack for holding a plurality of skis and poles that can be conveniently used inside a restaurant or home.

It is a further object of the subject invention to provide a ski rack for holding skis and poles that will catch water drainoff.

Another and further object of the invention is the provision of a ski rack that can be dismantled and transported in a compact disassembled package.

DETAILED DESCRIPTION OF THE PREFERRED EMBODIMENTS

Figure 1:
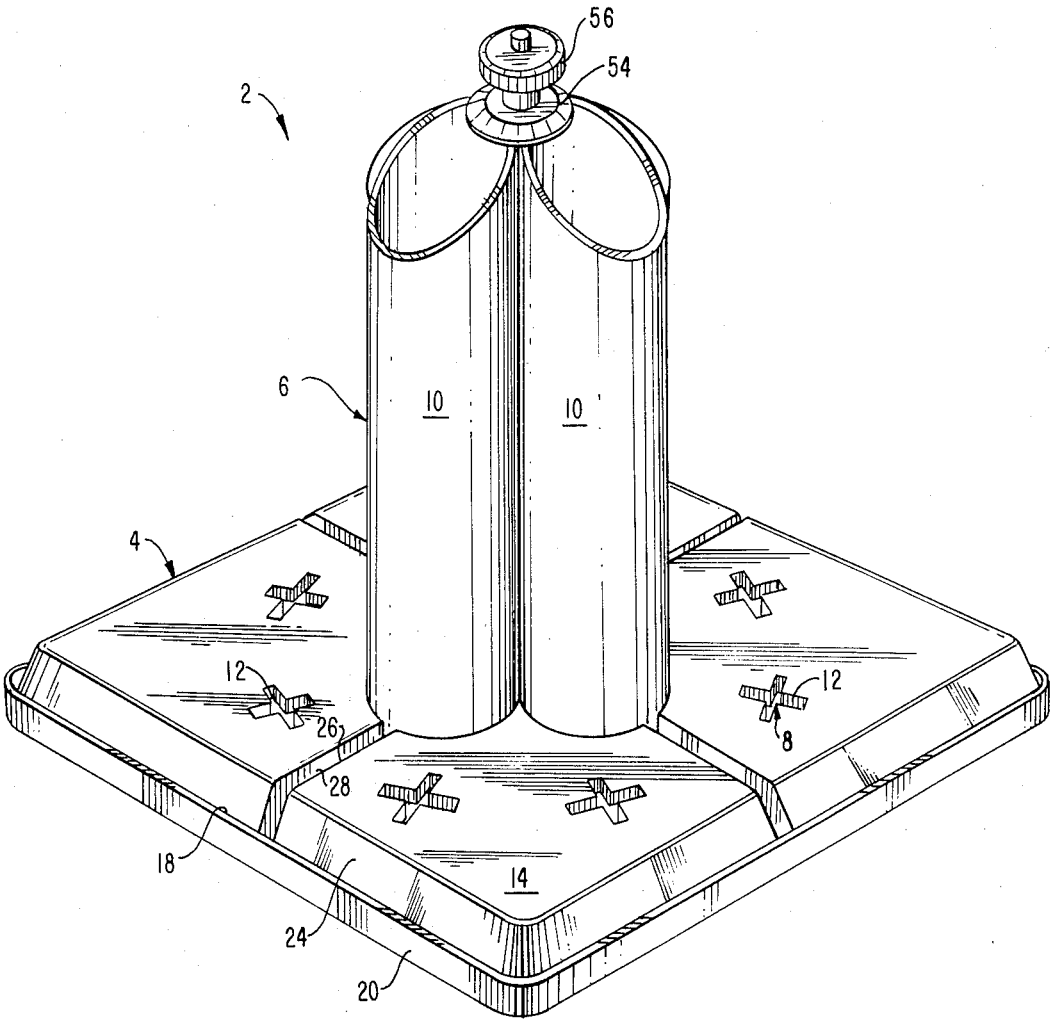
FIG. 1 is a perspective view of the ski rack according to the subject invention.

The ski rack according to the subject invention is shown in FIG. 1 and is generally indicated by the numeral 2. The ski rack 2 is comprised essentially of a base 4, ski holding means 6 and means 8 formed in the base 4 to secure or accomodate ski poles. The ski holding means 6 extends perpendicularly from the base 4. The ski holding means 6 is formed of and includes a plurality of elongated tubular members 10. The tubular members 10 must be wide enough to accept a pair of skis. It should be recognized that the elongated members may be made in any shape and configuration that will accept the skis including rectangular. A three inch diameter tubular member 10 has been found to permit the skis to be inserted and removed easily without much play.

Figure 5:
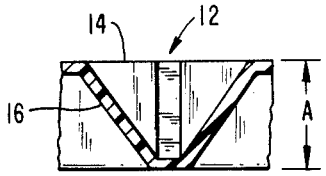
FIG. 5 is a sectional view taken along line 5—5 of FIG. 3.

The means 8 to secure the ski poles consists of a plurality of "X" shaped cavities 12 in the base 4. The cavities 12 project downwardly from the upper surface 14 of the base 4. The depth of each cavity 12 should be sufficient to support the weight of a ski pole in the vertical position. A detail of a cavity is shown in FIG. 5 in which the depth is indicated by the letter A. The depth A should generally be in the range of one to two inches. The preferred dimension is one and one-half inches. As can be seen in FIG. 5, the arms 16 of the cavity 12 extend from the top to the bottom on an angle of approximately 45°.

Figure 3:
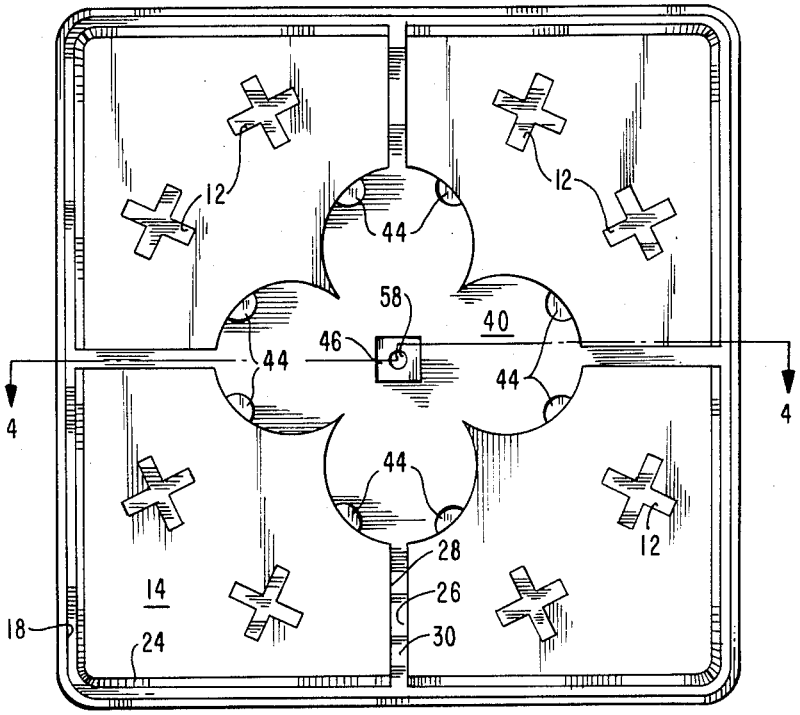
FIG. 3 is a top plan view of the base of the ski rack according to the subject invention.
Figure 4:
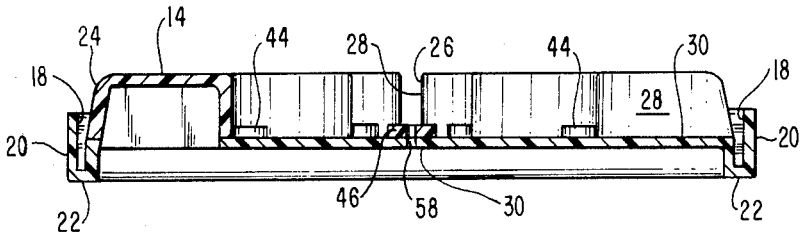
FIG. 4 is a sectional view taken along line 4—4 in FIG. 3.

The base 4 includes outer channel 18 for collecting water drain-off from snow melting on the skis. The outer channel 18 runs along the perimeter of the base 4 and is defined by an outer lip 20, a bottom 22 and a side wall 24 which extends between the upper surface 14 and the bottom 22, as better seen in FIGS. 3 and 4. The outer channel 18 is connected to the ski holding means 6 by inner channels 26. The inner channels 26 are defined by side walls 28 and a bottom 30 as can be seen in FIGS. 3 and 4. The bottom 30 is oriented at a pitch downward from the holding means 6 toward the outer channel 18, thereby permitting the water drain-off from the skis to flow through the inner channels 26 and collect in the outer channel 18.

The ski rack 2 may be made of any material such as plastic, wood or metal.

Figure 2:
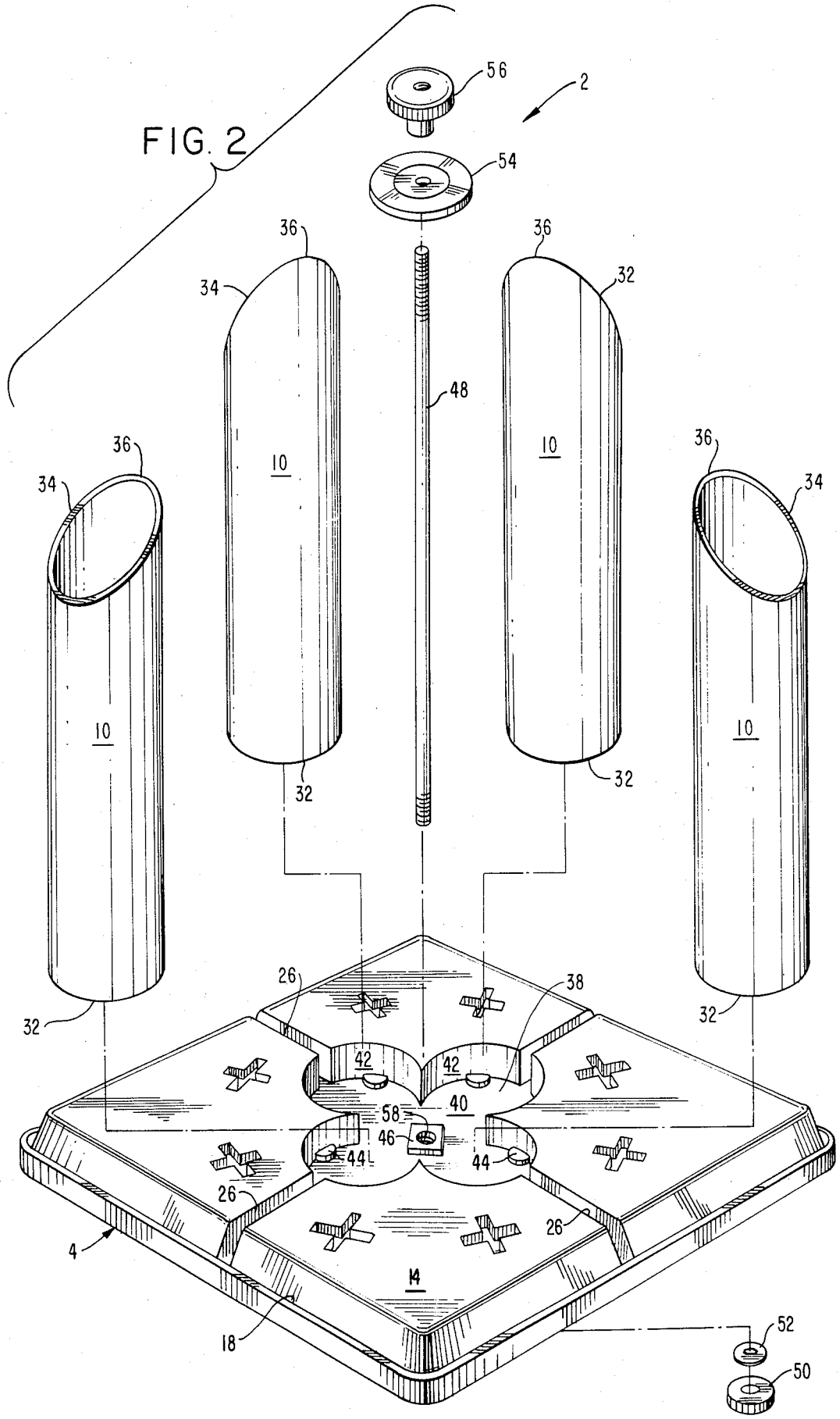
FIG. 2 is an exploded view of one embodiment of the ski rack according to the subject invention.

In the disassemblable embodiment of the ski rack 2 of the subject invention the ski holding means 6 and the base 4 are separate elements and means are provided to releasably retain the ski rack 2 in a secure assembled mode. In the embodiment shown in FIG. 2 the ski holding means 6 consists of four elongated tubular members 10. Practice has shown that polyvinylchloride is a particularly suitable material for the ski holding tubular members 10. The bottom 32 of the tubular members 10 is perpendicular to the longitudinal axis thereof. The top 34 of the tubular members 10 is cut on an angle to the longitudinal axis of approximately 45°. Thus, there is formed an upper edge 36 the significance of which will be explained later.

The base includes a recessed section 38 in the center of the base for receiving the tubular members 10. The recessed section 38 is defined by a bottom wall 40 and arcuate walls 42 extending between the upper surface 14 and the bottom wall 40. The arcuate walls 42 are substantially in the shape of tubular members 10 for a snug fit therein to provide additional leverage for maintaining the skis in the vertical position. Nibs 44 project upward from bottom wall 40 against arcuate walls 42. In addition, a platform 46 projects upwardly from the bottom wall 40 at the center thereof. Thus, when the tubular members 10 are placed in the recessed section 38, the bottom edges 32 of tubular members 10 are spaced from bottom wall 40. The spacing allows the water runoff from the snow melting on the skis to be drained off through the inner channels 26 into outer channel 18.

The means provided to secure the ski holding means 6 to the base 4 includes a threaded rod 48 with a nut-washer assembly 50–52 for the bottom and a cap 54 and knob 56 for the top.

To assemble the ski rack 2, the tubular members 10 are placed in the recessed section 40 arranged so that the upper edges 36 are facing each other. The tubular members 10 are secured to the base 4 by the threaded rod 48, one end of which protrudes through an aperture 58 in the center of the base 4. The nut and washer 50, 52 are screwed on the portion of rod 48 protruding below the base 4. The threaded rod 48 extends beyond the upper edges 36 of the tubular members 10 and is threaded to releasably receive the cap 54 and knob 56. The cap 54 grips the top edges 36 of the tubular members 10 when the knob 56 is tightened, thus maintaining the ski rack 2 in the assembled mode as shown in FIG. 1.

The ski rack 2 maintains the skis in a vertical position by selecting the ski holding means 6 to minimize the bending moment of the skis. In practice it has been found that the bending moment is minimized when the length of the tubular members 10, measured from the bottom edge 32 to the upper edge 36, is approximately 14 inches.

Additionally, the base 4 as shown in FIG. 3, is by itself a platform that can be used solely as a ski pole holder.

Although the preferred embodiments of the subject invention have been described and illustrated, it is obvious that various changes and modifications can be made therein without departing from the spirit of the present invention which should be limited only by the scope of the appended claims.

What is claimed is:

1. A ski rack for holding a plurality of skis and ski poles in a vertical position, comprising:

(a) a base;

(b) means in said base for holding said ski poles in a vertical position;

(c) a plurality of elongated tubular members for supporting the skis, said tubular members being disassemblably connected to and extending perpendicular from a recessed section in said base, said tubular members being also substantially contiguous to each other and contained in the center of said base;

(d) securing means which secures said tubular members to said base; and (e) means in said base for catching water including an outer channel along the perimeter of said base and four inner channels connecting said recessed section to said outer channel.

2. A ski rack as in claim 1 wherein the ski pole holding means comprises a plurality of "X" shaped cavities in said base in which the poles are inserted, and cavities being of sufficient depth to maintain the ski poles in the vertical position.

3. A ski rack as in claim 1 wherein the base is an integral unit and is made of plastic.

* * * * *